US008388711B2

(12) United States Patent
Garner et al.

(10) Patent No.: US 8,388,711 B2
(45) Date of Patent: Mar. 5, 2013

(54) AUTOSELECTIVE REGENERATING PARTICULATE FILTER

(75) Inventors: Colin Peter Garner, Loughborough (GB); John Ernest Harry, Oakham (GB)

(73) Assignee: Perkins Engine Company Ltd., Peterborough (GB)

( * ) Notice: Subject to any disclaimer, the term of this patent is extended or adjusted under 35 U.S.C. 154(b) by 854 days.

(21) Appl. No.: 11/990,914

(22) PCT Filed: Aug. 22, 2006

(86) PCT No.: PCT/GB2006/003114

§ 371 (c)(1), (2), (4) Date: Sep. 2, 2009

(87) PCT Pub. No.: WO2007/023267

PCT Pub. Date: Mar. 1, 2007

(65) Prior Publication Data

US 2010/0154632 A1 Jun. 24, 2010

(30) Foreign Application Priority Data

Aug. 25, 2005 (GB) ..... 0517428.9

(51) Int. Cl.

| | |
|---|---|
| ***B01D 50/00*** | (2006.01) |
| ***B01D 39/06*** | (2006.01) |
| ***B01D 39/14*** | (2006.01) |
| ***B01D 24/00*** | (2006.01) |
| ***F01N 3/00*** | (2006.01) |

(52) U.S. Cl. ..... 55/282.3; 55/522; 55/523; 55/524; 60/297; 422/169; 422/170; 422/171; 422/172; 422/179; 422/180; 422/181; 422/182; 422/177; 422/178

(58) Field of Classification Search ..... 55/282.3, 55/522–524; 422/169–172, 177–182; 60/297; 30/297

See application file for complete search history.

(56) References Cited

U.S. PATENT DOCUMENTS

| | | | | |
|---|---|---|---|---|
| 5,409,668 | A * | 4/1995 | Bagley et al. | 422/174 |
| 6,508,852 | B1 * | 1/2003 | Hickman et al. | 55/523 |
| 6,673,300 | B2 * | 1/2004 | Allen et al. | 264/400 |
| 2001/0054277 | A1 * | 12/2001 | Stopler | 55/282.3 |

(Continued)

FOREIGN PATENT DOCUMENTS

| | | |
|---|---|---|
| DE | 37 05 979 A1 | 9/1988 |
| DE | 41 03 653 C1 | 6/1992 |

(Continued)

OTHER PUBLICATIONS

PCT International Search Report mailed Nov. 13, 2006 in Application PCT/GB2006/003114 (4 pages).

(Continued)

*Primary Examiner* — Amber Orlando

(57) ABSTRACT

The present disclosure provides an apparatus and method for removing particulates from a gas stream. The apparatus includes a ceramic filter, at least one electrode, and at least one conductor. The electrode is located at an end of the filter and produces an atmospheric glow discharge in order to oxidize carbon deposits trapped in the filter. The conductor extends at least partially into the filter and acts as a counter electrode. Through various arrangements of the electrodes and conductors, the present disclosure provides closer connection between the trapped carbon deposits and the electrodes. This improves the regeneration of the filter without increasing the size and/or weight of the apparatus.

21 Claims, 3 Drawing Sheets

U.S. PATENT DOCUMENTS

| | | | | |
|---|---|---|---|---|
| 2003/0182930 | A1* | 10/2003 | Goulette et al. | 60/275 |
| 2004/0088955 | A1 | 5/2004 | Garner et al. | |
| 2005/0175514 | A1* | 8/2005 | Ohno | 422/177 |
| 2005/0284137 | A1* | 12/2005 | Son | 60/295 |
| 2006/0048506 | A1* | 3/2006 | Son | 60/295 |
| 2006/0051264 | A1* | 3/2006 | Son | 422/211 |
| 2006/0254264 | A1* | 11/2006 | Takenaka et al. | 60/297 |
| 2007/0028603 | A1* | 2/2007 | Igarashi | 60/295 |

FOREIGN PATENT DOCUMENTS

| | | | |
|---|---|---|---|
| DE | 102 29 881 | A1 | 1/2004 |
| EP | 1524416 | A1 | 4/2005 |
| GB | 2351923 | A | 1/2001 |
| JP | 59 127621 | A | 7/1984 |
| JP | 06 146852 | A | 5/1994 |
| JP | 2004 332608 | A | 11/2004 |

OTHER PUBLICATIONS

British Search Report mailed Nov. 2, 2005, in Application No. GB0517428.9 (3 pages).

* cited by examiner

AUTOSELECTIVE REGENERATING PARTICULATE FILTER

PRIORITY STATEMENT

This application is the National Stage, filed under 35 U.S.C. §371, of International Application Number PCT/GB2006/003114 having an International Filing Date of Aug. 22, 2006. Applicants claim benefit of priority under 35 U.S.C. §119(a) and §365(b) of British Patent Application No. 0517428.9 filed Aug. 25, 2005.

TECHNICAL FIELD

The present disclosure relates to an apparatus and method for removing particulates from gas streams, the apparatus being autoselectively regenerating (self-cleaning) in use.

BACKGROUND OF THE INVENTION

Internal combustion engines and static hydrocarbon burning equipment tend to emit, via their exhaust systems, carbonaceous particles commonly referred to as particulates. While efforts are being expended towards reducing particulate emissions at source, particulate filters (traps) in the exhaust systems of such equipment are becoming useful in helping to meet increasingly strict environmental legislation and public expectations.

Particulate filters which may be regenerated are known. It is especially desirable for a particulate filter to be self-regenerating in use, under any load, in order to maintain filtering and gas-flow efficiencies above a certain level while keeping filter size to a minimum. It is also desirable that the filter is self-controlled to regenerate when a predetermined level of particulates is present and to do so without requiring any external sensing means. It is further desirable that the regeneration process is economic in the use of any externally supplied energy or material, that the construction of the filter is also economic, and that the system is effective irrespective of types and compositions of fuel and engine operating conditions.

WO 01/04467 ("WO '467") to the same applicant discloses an apparatus and a method for removing particulates from a gas stream. WO '467 discloses a ceramic monolith filter of depth less than 100 mm which uses a first electrode to produce an atmospheric glow discharge near to the first end of the filter. Although the combination of a reduced-depth ceramic filter and atmospheric glow discharge has provided far more efficient particulate removal and filter regeneration performance compared to earlier known arrangements, the applicant has established that performance can be improved still further.

SUMMARY

According to a first aspect of the present disclosure, there is provided an apparatus for removing particulates from a gas stream, the apparatus comprising:

a ceramic filter through which gas may be caused to flow, the filter having a first end and a second end and including a plurality of elongate cells extending substantially parallel to the direction of gas flow;

at least one electrode located at an end of the filter for producing an atmospheric glow discharge; and at least one conductor spaced away from the at least one electrode and configured to lead current from the electrode out of the filter, wherein the conductor extends at least partially into the filter.

According to a second aspect of the present disclosure, there is provided an apparatus for removing particulates from a gas stream comprising:

a ceramic filter through which gas may be caused to flow, the filter having a first end and a second end and including a plurality of elongate cells extending substantially parallel to the direction of gas flow;

at least one electrode located at an end of the filter for producing an atmospheric glow discharge; and at least one conductor spaced away from the at least one electrode and configured to lead current from the electrode out of the filter, wherein the apparatus is mounted within a filter housing, the housing being provided with apertures for the ingress and egress of gas, and wherein the at least one conductor includes a portion of the housing.

According to a third aspect of the present disclosure, there is provided a method of removal of particulates from a gas stream comprising:

causing the gas to flow through a ceramic filter so that particulates are separated from the gas flow and trapped by the filter, wherein the filter has a first end and a second end and includes a plurality of elongate cells extending substantially parallel to the direction of gas flow;

positioning at least one electrode at an end of the filter;

positioning at least one conductor at a location spaced away from the at least one electrode, such that the conductor extends at least partially into the filter;

generating an atmospheric glow discharge from the electrode; and leading current from the electrode out of the filter through the conductor.

BRIEF DESCRIPTION OF THE DRAWINGS

Preferred embodiments of the disclosure will now be described, by way of example only, with reference to the accompanying drawings, in which.

DETAILED DESCRIPTION

Figure 1:
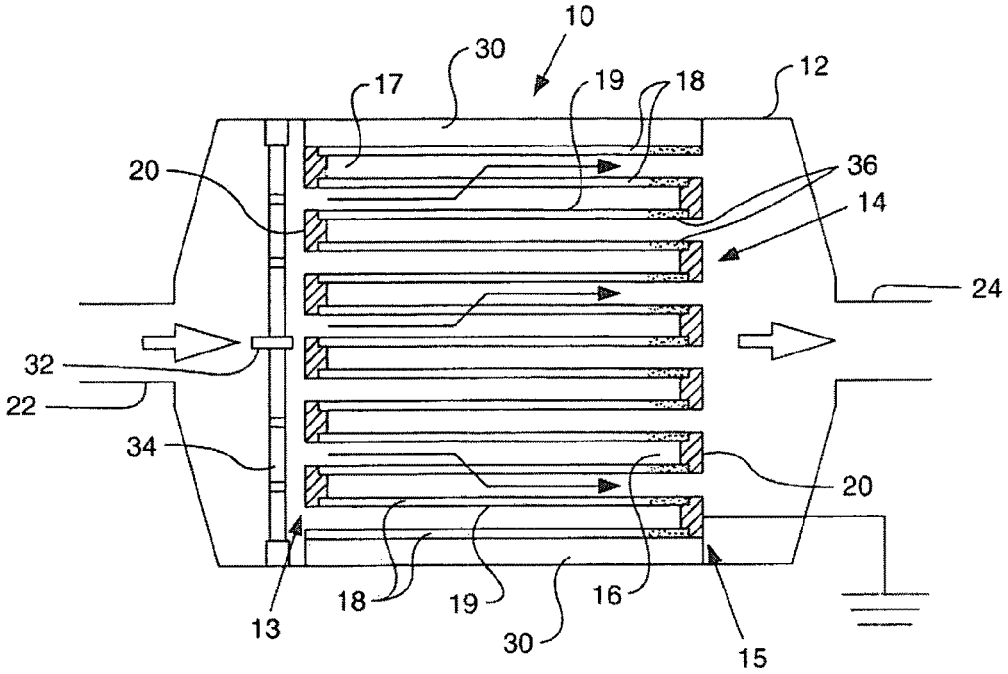
FIG. 1 shows a schematic vertical section through a first embodiment of an apparatus for removing particulate matter from a gas stream.

Referring to the drawings, each embodiment of the apparatus is shown schematically through a vertical cross-section. In addition, each embodiment of the apparatus is described when in use in the exhaust system of an internal combustion engine. However, it will be understood that the disclosure is not limited to internal combustion engine applications.

Each embodiment shown has a particulate filter 10 including a housing, or canister, 12 in which a filter body 14 is housed. The filter body 14 includes a plurality of elongate tubular inlet and outlet cells 16, 17 extending across the depth of the filter body 14. In other words, the inlet and outlet cells 16, 17 extend substantially parallel to the gas flow through the filter 10. Each cell 16, 17 is defined by a porous ceramic wall 18 and each has one end blanked off by a ceramic plug 20. Unless where stated otherwise, the filter body 14 is mounted within the housing 12 on an electrically insulated mounting sleeve 30.

Exhaust gases entering the filter via an inlet port 22 are compelled to pass into alternate inlet cells 16 of the filter body 14 and through a corresponding wall 18. Depending on the configuration, up to 90% of particulate mass may be filtered by deposition on an inner wall surface 19. The cleaned exhaust gases exit the filter 10 via an outlet port 24.

In addition, each of the embodiments that will be described is provided with at least one high voltage (HV) electrode for producing an atmospheric glow, or glow-like, discharge in the filter 10. In the embodiments described, each HV electrode is connected to a power supply (not shown in the drawings) suitable for the particular application of the apparatus. For example, the power supply may be a 12V power supply when used for vehicle applications, or a 230V power supply when used for generator applications. In one embodiment, the power supply may be adapted to generate square-wave pulses at a frequency within the range of 1 kHz to 200 kHz. Preferably, the voltage is generated at a frequency within the range of 18 kHz to 30 kHz, and most preferably within the frequency range 20 kHz to 25 kHz. An example of a preferred range for the open circuit output voltage provided by the power supply is between 5 kV and 25 kV, although it is most preferably 10 kV. A frequency of 20 kHz is outside of the normal human audio range upper limit of 16-18 kHz and is a relatively safe frequency in conjunction with the current flow of the apparatus.

The apparatus will also work effectively at higher frequencies, for example 38 MHz, but the aforementioned frequency ranges were selected because of their human comfort and practical advantages. The preferred frequency ranges have a strong advantage over higher frequencies which would be expensive to achieve at the necessary power levels and which would require circuits generally less robust and which cannot readily be miniaturised.

FIG. 1 shows a first embodiment of an apparatus according to the present disclosure, including the features already described above. In this first embodiment, the HV electrode is a point electrode 32 which is held by a support means 34 axially spaced apart from a first end 13 of the filter body 14. The electrode 32 is axially spaced from the filter body by a distance of between 2 and 5 mm. The support means 34 is perforated to permit the passage of exhaust gases therethrough. In this embodiment, the electrode 32 is manufactured from mild steel rod and can have any suitable diameter, as it is positioned outside the filter.

In all of the illustrated embodiments, a conductor is provided at a second (downstream) end 15 of the filter body 14, spaced away from the HV electrode. The conductor is adapted to lead current from the HV electrode out of the filter and return it to the power supply. For the preferred embodiments illustrated, the conductor takes the form of a counter electrode, except where stated otherwise. However, it should be understood that other suitable conductors may be used as well as the counter electrodes described. In the embodiment illustrated in FIG. 1, the counter electrode is formed by impregnating at least a portion of the filter body 14 adjacent the second end 15 with a conductive material 36, such that the impregnated portion extends from the second end 15 of the filter body 14 towards the first end 13 until it has at least passed the ceramic end plugs 20 at the second end 15. As a result of impregnating the filter body 14, electrical contact is made between the counter electrode (the impregnated second end 15 of the filter body 14) and the trapped particulate matter. Thus, when the electrode 32 produces an atmospheric glow discharge in the gap between the electrode 32 and the filter body 14, the trapped particulate matter held by the filter acts as grounding sites for the atmospheric glow discharge, and the discharge oxidizes the particulate matter. With the electrical contact between the impregnated filter body 14 and the particulate matter, the penetration of the atmospheric glow discharge from the HV electrode 32 into the filter is improved, with more efficient oxidization of the particulate matter as a result.

Figure 2:
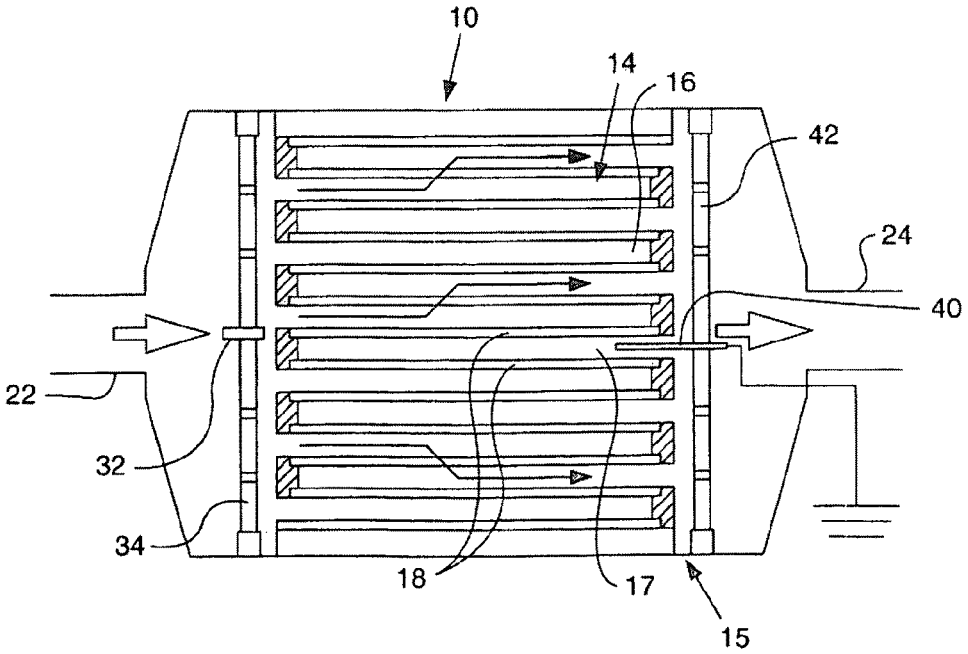
FIG. 2 shows a schematic vertical section through a second embodiment of the apparatus.

FIG. 2 shows a second embodiment of the present disclosure, where a different form of counter electrode is used. The second embodiment shares the majority of its features with the first embodiment, and the same reference numerals are used for the shared features. However, in the second embodiment the filter body is not impregnated with a conductive material in order to form the counter electrode. Instead, in the second embodiment the counter electrode is a conductive wire electrode 40. The conductive wire counter electrode 40 is held by a second support means 42 axially spaced from but near to the second end 15 of the filter body 14.

The counter electrode 40 is inserted into one of the outlet channels, or cells, 17 of the filter body 14 such that it extends at least partially into the filter 10 from the second end 15. The counter electrode 40 is inserted into the outlet cell 17 approximately 25 to 30 mm. This limited insertion is known as a shallow insertion. Such a shallow insertion of the counter electrode 40 again ensures a close connection between particulate matter trapped in the inlet cells 16 and the counter electrode 40, as the particulate matter trapped in the inlet cells 16 is only separated from the counter electrode by the thin porous wall 18 of the filter body 14. Such a close connection again improves the efficiency of the oxidation of the trapped particulate matter.

Figure 3:
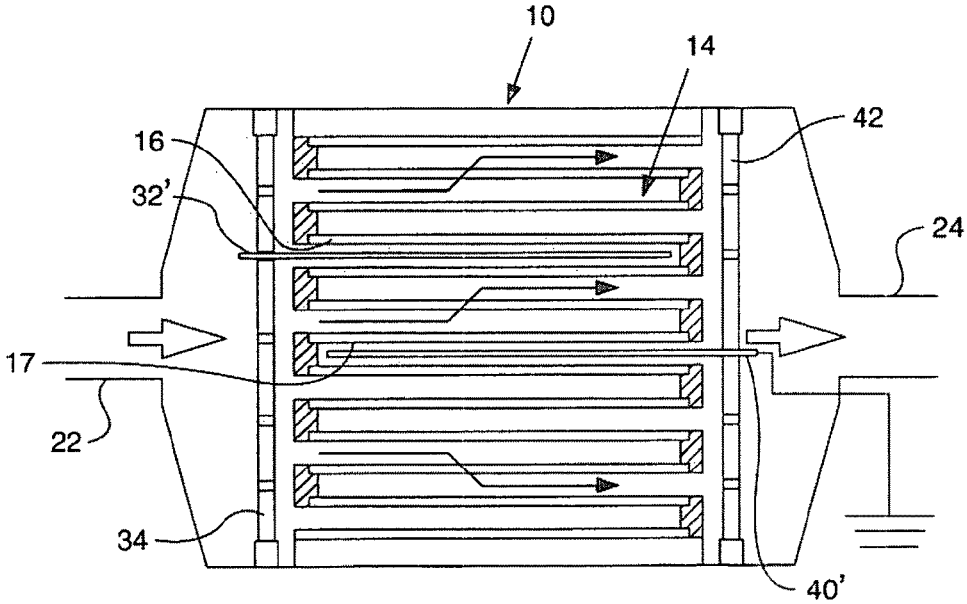
FIG. 3 shows a schematic vertical section through a third embodiment of the apparatus.

A third embodiment of the present disclosure is shown in FIG. 3. Again, features shared with the first and second embodiments are designated by the same reference numbers. The third embodiment differs from the second embodiment in that both the HV electrode 32' and conductive wire counter electrode 40' are now fully inserted into the filter body 14. The HV electrode 32' is inserted into an inlet cell 16 while the counter electrode 40' is inserted into an outlet cell 17, thus minimising the chances of discharges between the two electrodes 32', 40' outside the filter body 14. If desired, the locations of the electrodes 32', 40' could be reversed, such that the counter electrode 40' is in an inlet cell 16 and the HV electrode 32' is in an outlet cell 17. This would have no negative effect on the regeneration performance. By fully inserting the electrodes 32', 40' into the cells 16, 17 of the filter body 14, the full length of each cell 16, 17 can be regenerated.

Figure 4:
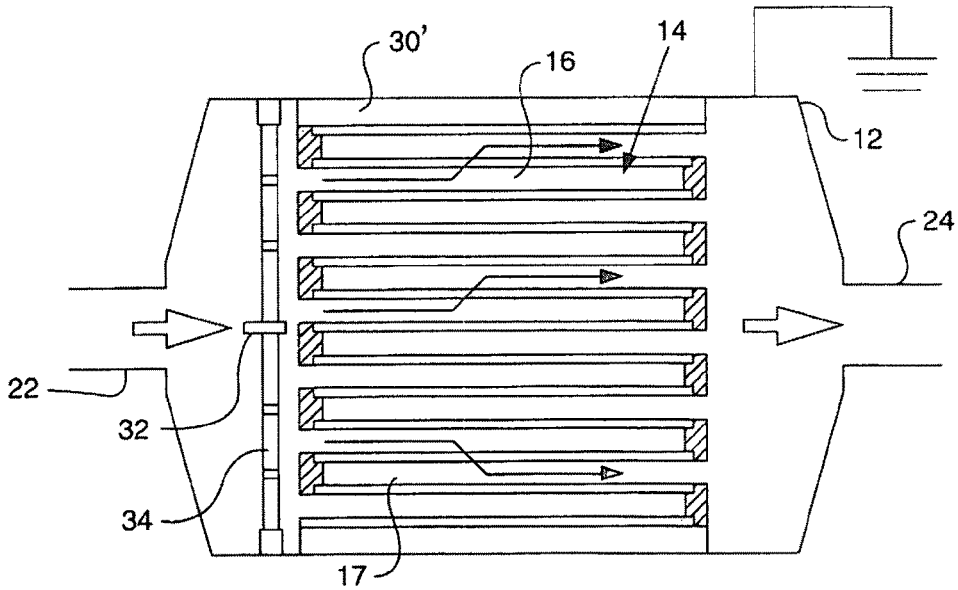
FIG. 4 shows a schematic vertical section through a fourth embodiment of the apparatus.

FIG. 4 shows a fourth embodiment of the present disclosure. Features shared with the previously described embodiments are again assigned the same reference numbers. In this fourth embodiment, no separate conductor is provided. Instead, the mounting sleeve 30' no longer electrically insulates the filter body 14 from the housing 12. As a result, this allows a portion of the housing 12 to act as the conductor by using the inherent capacitive reactance of the filter body 14 to complete the circuit from the HV electrode 32 to the housing 12.

Industrial Applicability

The various embodiments of the present disclosure described herein are intended for use in the exhaust systems of internal combustion engines and the like. The disclosed embodiments offers improved filter regeneration over existing proposals thanks to the close connection between the trapped particulate matter and the HV electrodes and conductors. Using the various types of HV electrodes and conductors described, locating them either partially or fully inside the ceramic filter, and locating the filter within an exhaust system, improves regeneration performance without producing any significant increase in exhaust backpressure. Furthermore, this improvement in regeneration performance does not require an increase in the overall size of the filter. Thus, the improved regeneration performance does not come at a cost in terms of increased weight and/or dimensions.

Although various embodiments of the present disclosure have been described above, further modifications are also possible. For example, the end plugs which close off each cell of the filter body could be made of a conductive material. The end plugs could then act as the HV electrodes and/or conductors for the filter apparatus.

Furthermore, although the HV electrode has been described as being a pin electrode, it may also take other forms. For example, a mesh electrode could be used as the HV electrode. The mesh electrode would act as a pin electrode having a large surface area. Thus, the mesh electrode could cover a larger surface area of the filter. In addition, the HV electrode could be formed by impregnating the first end of the filter body, in the same manner as used for the counter electrode in the first embodiment of the disclosure described above.

With regard to the inserted electrode arrangement of the third embodiment, the inserted electrodes could take a number of forms, rather than the pin electrodes shown. For example, the cells could be coated or impregnated with a conductive material. In addition, the HV electrode of the third embodiment could be located in an outlet cell of the filter body, with the counter electrode formed as a conductive impregnation or coating of the first (upstream) end of the filter body. This would ensure contact between the trapped particulate matter and the counter electrode, whilst preventing direct contact between the HV electrode and particulate matter (which can result in no discharge occurring).

As explained above, each embodiment includes at least one HV electrode and at least one conductor. With the exception of the embodiments in which the electrodes are formed by impregnation of the filter, it is preferable for a plurality of HV electrodes to be used in embodiments under the disclosure. For example, in one preferred embodiment 30 HV electrodes are utilised. In one embodiment where multiple HV electrodes are utilised, each electrode in the array is provided with a dedicated electrical stabilizing element. The stabilizing elements preferably stabilize the electrodes by providing a resistance between the power supply and each HV electrode. The stabilizing elements can be simple resistors, or else they may be elements which provide an inductive or capacitive resistance. The provision of the stabilizing elements ensures effective operation of the HV electrodes. Without the stabilising elements, the atmospheric glow discharges could favor particular electrodes and areas of the particulate trap.

A further improvement in regeneration performance can be achieved by pulsing, or modulating, the power supply. This involves switching the power supply on and off for very short periods. As an example, the on and off periods could be in the range of 10 ms to 1 s, with a maximum cycle time (the beginning of the on period to the end of the off period) of 3 s. Unlike with the known mark space ratio, the on and off periods would be variable instead of fixed. By pulsing the power supply in such a manner, thermal damage to the filter caused by the discharge can be reduced or eliminated altogether. The number of complete on/off cycles can also be varied by switching the power supply off for a longer period than the cycle time. This will ensure that the discharge moves about the inlet cells of the filter body and does not remain in one location.

As regards the relative positions of the electrodes and conductors and the filter body, the preferred embodiments have described the electrode as being sited at an upstream first end of the filter and the conductor being sited downstream of the electrode. These locations are used by way of example only. It will be appreciated by the skilled person that embodiments under the disclosure will still operate with the electrode and conductor in the reverse arrangement. In addition, both the electrode and conductor may be located at the same end of the filter without any reduction in regeneration performance. Such an arrangement is shown schematically in FIG. 5 where the downstream end of the filter body 14' is shown.

Figure 5:
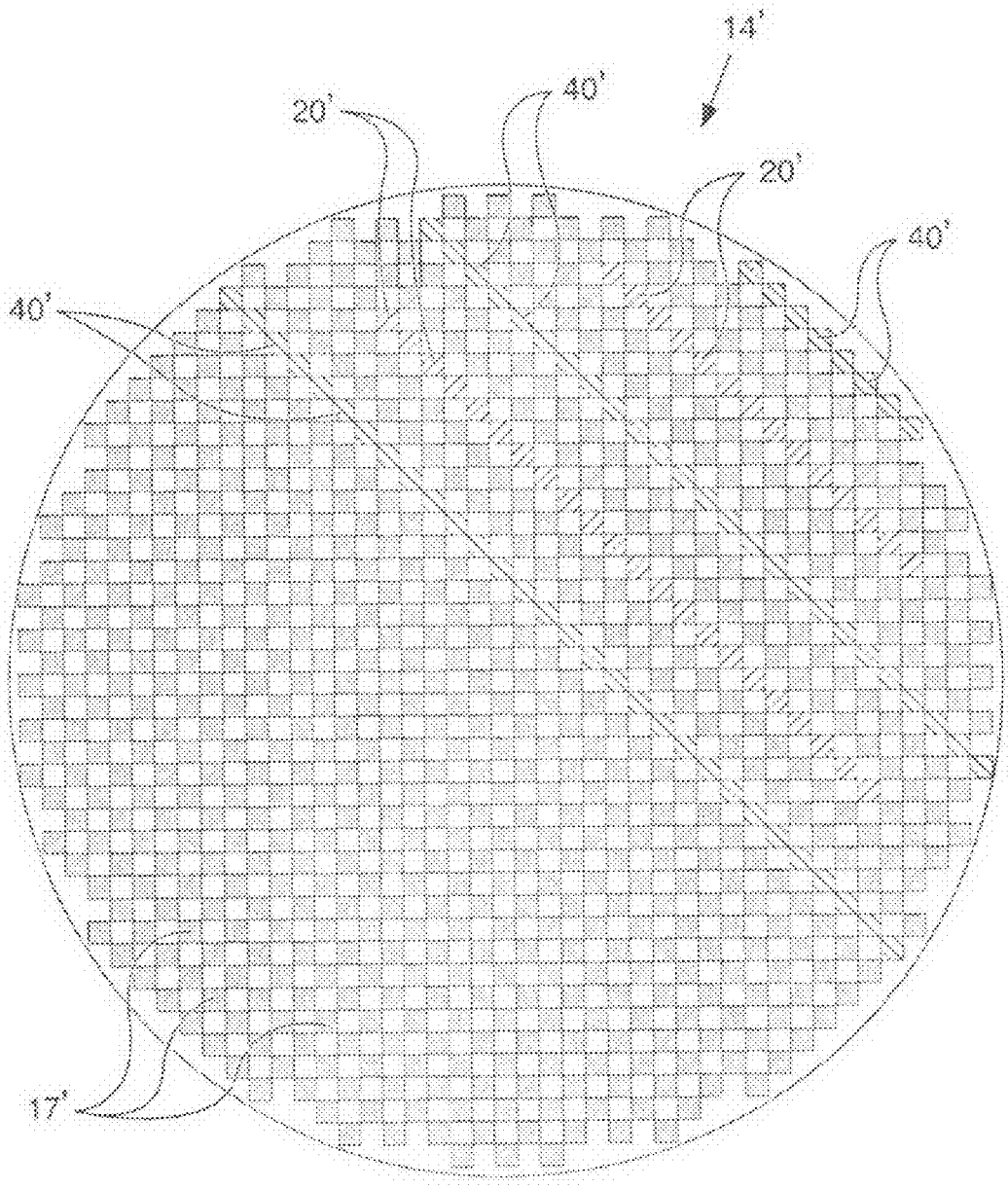
FIG. 5 shows a schematic end view of a ceramic filter forming part of the apparatus.

The filter body 14' of the illustrated embodiment is cylindrical and would normally be enclosed by a filter housing, but this has been removed for illustrative purposes. As already described, the filter body 14' is made up of a number of inlet and outlet cells, and the open ends of the outlet cells 17' can be seen in FIG. 5. In the arrangement shown, a number of HV electrodes 20' are at least partially inserted into some of the outlet cells 17' of the filter body 14'. The HV electrodes 20' are each inserted into particular outlet cells 17' so that the HV electrodes 20' are positioned in a linear arrangement. Although FIG. 5 shows each HV electrode 20' located in adjacent outlet cells 17', it will be appreciated that the HV electrodes 20' can be arranged in non-adjacent outlet cells 17' and still form a linear arrangement.

As well as the HV electrodes 20', a number of conductors in the form of counter electrodes 40' are also inserted into some of the outlet cells 17' of the filter body 14'. Again, the counter electrodes 40' are also arranged in the outlet cells 17' so that they form a linear arrangement, and may also be located in non-adjacent outlet cells 17' to form the linear arrangement. The HV and counter electrodes 20', 40' are arranged in alternate lines across the end of the filter body 14'. By arranging the HV and counter electrodes 20', 40' in this way, a more uniform oxidation of particulate matter trapped in the filter is achieved when the HV electrodes produce their atmospheric glow discharges. Alternatively, the linear arrangements of HV and counter electrodes 20', 40' could be inserted into the cells of the filter such that they form particular shapes, e.g. a substantially hexagonal shape.

These and other modifications and improvements may be incorporated without departing from the scope of the disclosure.

The invention claimed is:

1. An apparatus for removing particulates from a gas stream, the apparatus comprising:

a ceramic filter through which gas may be caused to flow, the filter having a first end and a second end and including a plurality of elongate cells extending substantially parallel to the direction of gas flow, each elongate cell of the filter being closed either the first or second end of the filter by an end plug;

at least one electrode located at the first end of the filter for producing an atmospheric glow discharge; and at least one conductor spaced away from the at least one electrode and configured to lead current from the electrode out of the filter, the at least one conductor comprising a portion of the filter including a conductive material;

wherein the portion of the filter including the conductive material extends at least partially into the filter from an end face of the filter past at least one of the end plugs.

2. The apparatus of claim 1, wherein the portion of the filter including the conductive material includes a portion of the filter impregnated with the conductive material.

3. The apparatus of claim 1, wherein the end plugs at the second end are made from a conductive material, and the at least one conductor includes a conductive end plug.

4. An apparatus for removing particulates from a gas stream, the apparatus comprising:

a ceramic filter through which gas may be caused to flow, the filter having a first end and a second end and including a plurality of elongate cells extending substantially parallel to the direction of gas flow;

at least one electrode located at the first end of the filter for producing an atmospheric glow discharge; and at least one conductor spaced away from the at least one electrode and configured to lead current from the electrode out of the filter, wherein the apparatus is mounted within a filter housing, the housing being provided with apertures for the ingress and egress of gas, and wherein the at least one conductor includes a portion of the housing extending along at least a majority of a length of the filter extending between the first and second ends.

5. The apparatus of claim 4, wherein the at least one electrode includes a first point electrode.

6. The apparatus of claim 4, wherein the at least one electrode is located near to but spaced apart from the first end of the filter.

7. The apparatus of claim 4, wherein the at least one electrode is located at least partially within one of the elongate cells.

8. The apparatus of claim 4, wherein the at least one electrode includes a portion of the filter adjacent the first end thereof, the portion impregnated with a conductive material.

9. The apparatus of claim 4, wherein the and conductor is located at the second end of the filter.

10. The apparatus of claim 4, wherein the electrode and conductor are located at the same end of the filter.

11. The apparatus of claim 10, wherein the first and second ends of the filter are the downstream and upstream ends, respectively, of the filter, and the electrode and conductor are located at the downstream end of the filter.

12. The apparatus of claim 4, wherein the at least one electrode is connected to an AC voltage supply generating an AC voltage in a frequency within the range of 1 kHZ to 200 kHZ.

13. The apparatus of claim 12, wherein the voltage supply is pulsed.

14. A method of removal of particulates from a gas stream, the method comprising:

causing the gas to flow through a ceramic filter so that particulates are separated from the gas flow and trapped by the filter, wherein the filter includes a plurality of elongate cells extending substantially parallel to the direction of gas flow;

positioning a plurality of electrodes at a first end of the filter;

positioning a plurality of conductors at the first end of the filter and spaced away from the electrode, the plurality of conductors extending at least partially into the filter, the plurality of electrodes or the plurality of conductors arranged to form a linear arrangement in adjacent cells;

generating an atmospheric glow discharge from the plurality of electrodes; and leading current from the plurality of electrodes out of the filter through the plurality of conductors.

15. The apparatus of claim 1, wherein the at least one electrode includes a first point electrode.

16. The apparatus of claim 1, wherein the at least one electrode is located near to but spaced apart from the first end of the filter.

17. The apparatus of claim 1, wherein the at least one electrode is located at least partially within one of the elongate cells.

18. The apparatus of claim 1, wherein:

the at least one electrode includes a portion of the filter at the first end thereof, the portion of the at least one electrode being impregnated with a conductive material and extending at least partially into the filter from an end face of the filter past least one of the end plugs located at the first end of the filter; and the at least one conductor is located at the second end of the filter.

19. The apparatus of claim 1, wherein:

the at least one electrode includes a portion of the filter at the first end thereof, the portion of the at least one electrode including a conductive material and extending at least partially into the filter from an end face of the filter past at least one of the end plugs located at the first end of the filter; and the at least one conductor is located at the second end of the filter.

20. The method of claim 14, wherein the plurality of cells include a plurality of inlet and outlet cells, and the plurality of conductors extend at least partially into open ends of adjacent outlet cells to form the linear arrangement.

21. The method of claim 14, wherein the plurality of electrodes and the plurality of conductors are arranged in alternate linear arrangements.

* * * * *